United States Patent [19]

Kishimoto

[11] Patent Number: 5,058,277

[45] Date of Patent: Oct. 22, 1991

[54] COMPOUND ACTION CUTTING TOOL

[75] Inventor: Ikuo Kishimoto, Kakogawa, Japan

[73] Assignee: Fiskars OY AB, Helsinki, Finland

[21] Appl. No.: 680,595

[22] Filed: Mar. 29, 1991

Related U.S. Application Data

[63] Continuation of Ser. No. 461,018, Jan. 4, 1990, abandoned.

[51] Int. Cl.[5] ..... B26B 13/16; B26B 13/00; B26B 13/12; B26B 13/06

[52] U.S. Cl. ..... 30/252; 30/249; 30/261; 30/262

[58] Field of Search ..... 30/245, 249, 251, 252, 30/261, 262, 339, 340, 346, 351

[56] References Cited

U.S. PATENT DOCUMENTS

| | | | |
|---|---|---|---|
| 492,198 | 2/1893 | Hamann . | |
| 2,384,822 | 9/1945 | Drmic | 30/250 |
| 2,495,677 | 1/1950 | Boyer | 30/262 |
| 2,528,816 | 11/1950 | Boyer | 30/238 |
| 3,372,478 | 3/1968 | Wallace et al. | 30/193 |
| 3,650,028 | 3/1972 | La Pointe | 30/238 |
| 4,073,059 | 2/1978 | Wallace et al. | 30/261 |
| 4,079,514 | 3/1978 | Arlett | 30/261 |
| 4,156,311 | 5/1979 | Wallace et al. | 30/262 |
| 4,420,883 | 12/1983 | Wallace et al. | 30/251 |
| 4,442,603 | 4/1984 | Wallace et al. | 30/249 |

FOREIGN PATENT DOCUMENTS

| | | | |
|---|---|---|---|
| 3811229 | 10/1989 | Fed. Rep. of Germany | 30/262 |

*Primary Examiner*—Douglas D. Watts
*Assistant Examiner*—Paul M. Heyrana
*Attorney, Agent, or Firm*—Foley & Lardner

[57] ABSTRACT

A cutting tool has respective first and second tool members cooperating to effect a cutting stroke between an open position and a closed position. The cutting tool has a first tool member having a first handle rigidly connected to a first cutting member, and a second tool member including a second cutting member pivotally secured to the first cutting member and including a tab and an elongated shank portion formed thereon and defining a channel therebetween. The second tool member further includes a fulcrum rigidly secured to the second cutting member and configured for sliding interaction with the shank portion of the second cutting member to effect the cutting stroke. In addition, a locking member is slideably mounted in a longitudinally extending slot formed in the first handle. The locking member is slideable within the slot from a locked position in which it is received within the channel to an unlocked position in which it is located outside of the channel.

5 Claims, 4 Drawing Sheets

COMPOUND ACTION CUTTING TOOL

This is a continuation of application Ser. No. 07/461,018 filed Jan. 4, 1990 abandoned.

TECHNICAL FIELD

The present invention relates, generally, to variable force compound action leverage tools, and more particularly, to hand-held cutting tools including a compound leverage mechanism.

BACKGROUND OF THE INVENTION

Conventional hand-held garden tools, for example pruning snips, typically comprise an upper and a lower cutting blade, each having an elongated handle extending therefrom and configured to pivot about a single axis. For a constant force applied to the handles, the force generated at the cutting blades is essentially constant throughout the cutting stroke.

Shearing heavy growths, for example shrubbery and tree branches, however, often requires considerably greater force than that generated by single axis hand-held tools. The need for greater cutting force is especially pronounced where the operator's hand is small or otherwise not capable of delivering significant force to the handles.

In general, the use of compound leverage action mechanisms to increase the ratio of force applied at the handles to force delivered at the blades is well known. Compound leverage mechanisms have been employed, for example, in hook-and-blade-type pruning apparatus, in anvil-type tools, and in shears. Examples of such pruning apparatus are described in U.S. Pats. Nos. 4,420,883 and 4,442,603 issued to E. Wallace, et al. on Dec. 20, 1983 and Apr. 17, 1984, respectively. Examples of compound action shears are described in U.S. Pats. Nos. 492,198, issued to C. Hamann on Feb. 21, 1983, U.S. Pat. No. 2,384,822, issued Sept. 18, 1945 to S. Drmic, U.S. Pat. No. 2,528,816, issued to H. Boyer on Nov. 7, 1950, and U.S. Pat. No. 3,650,028, issued to G. LaPointe on Mar. 21, 1972. Use of compound action leverage mechanisms in lopping shears is also known, for example as described in U.S. Pat. No. 3,372,478, issued to E. Wallace, et al. on Mar. 12, 1968 and pending U.S. patent application Ser. No. 07/012,890, filed Feb. 10, 1987 by Wallace, et al.

However, known compound action leverage tools tend to be disadvantageous in a number of respects. Spring mechanisms, typically employed to urge the handles into the open position, are often disposed between the handles or otherwise external to the device. Consequently, the spring mechanism tends to become entangled in tall grass or nearby branches, thereby impeding the cutting process. Further, the stopping mechanism, typically employed to reduce shock to the cutting blades during closure thereof, tends to be relatively complex, thereby adding to the fabrication costs of the hardware.

SUMMARY OF THE INVENTION

The present invention provides a particularly advantageous compound action leverage mechanism, suitable for use in pruning shears, which overcomes the disadvantages of the prior art, and further, provides an improved spring return feature, locking mechanism, and limit stop.

More specifically, in accordance with one aspect of the present invention, the present inventors have determined that the operator's capacity to manually apply force to the handles is typically lower at the fully open position than at other points in the cutting stroke, for example at the closed handle position. Accordingly, the action mechanism is designed to provide the greatest leverage where it is most needed, i.e., at the fully opened position.

The cutting mechanism preferably comprises first and second cutting members and a lever arm configured to cooperate with the cutting members to effect a scissor-like cutting motion therebetween. The lever arm conveniently comprises a first handle which is affixed to and extends from the first cutting member, and a second handle. The respective cutting members are pivotally connected to each other, and the lever arm or second handle is pivotally connected to the first cutting member.

A sliding leverage mechanism is effected between a fulcrum mounted to the lever arm and a shank portion extending from the second cutting member. The respective pivot points and the (sliding) point of interaction between the lever arm or second handle and the second cutting member are configured to produce the greatest ratio of manually applied force to cutting force when the handles are in the open position.

In a preferred embodiment, the first and second cutting members comprise a hook and blade, respectively. The blade includes an elongated shank portion having a lengthwise edge thereof configured to interact with the fulcrum. The blade further comprises a tab portion which cooperates with a leaf spring to urge the handles into the open position.

In accordance with another aspect of the present invention, the blade further includes a channel substantially defined by and disposed between the shank and tab. A locking mechanism including a locking shaft is slidably mounted proximate the channel such that the shaft is constrained from entering the channel when the tool is open; when the tool is closed, the shaft may be urged into the channel, thereby locking the handles in the closed position against the opening force of the leaf spring.

In accordance with a further aspect of the invention, a portion of each handle comprises spaced apart side panels joined by a support panel. The handle comprising the lever arm includes a limit stop shaft rigidly mounted between the opposing side panels. The distal portion of the shank is configured to interact with the limit stop shaft to limit the extent of tool closure and, thus, prevent damage to the cutting mechanism and injury to the operator.

BRIEF DESCRIPTION OF THE DRAWING

A preferred exemplary embodiment of the present invention will hereinafter be described in conjunction with the appended drawing, wherein like numerals denote like elements and.

DETAILED DESCRIPTION OF PREFERRED EXEMPLARY EMBODIMENTS

Figure 1:
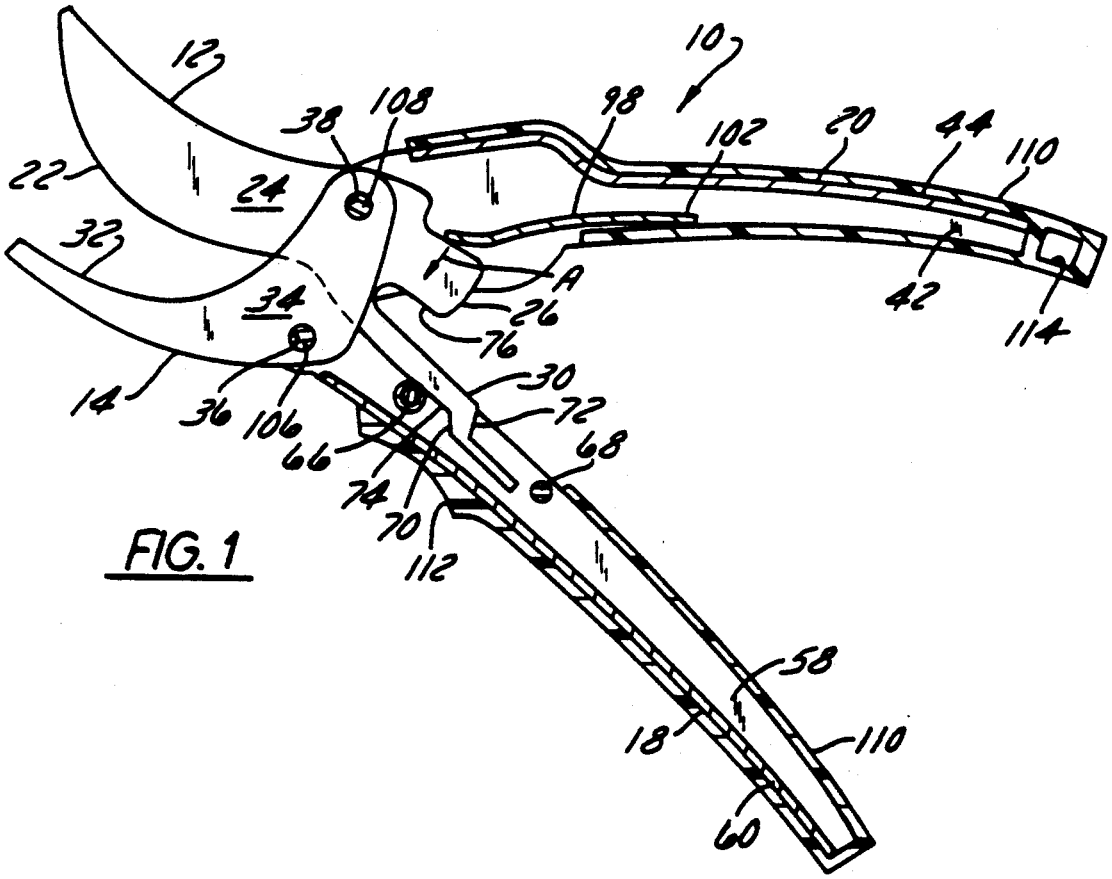
FIG. 1 is a cross-section side elevation view, taken along line Z—Z in FIG. 6, of an exemplary embodiment of a variable force cutting tool in accordance with the present invention, shown in the full open position.

Referring now to FIGS. 1-4, a variable force compound action cutting tool 10, in accordance with the present invention, comprises respective first and second cutting members 14 and 12, a first handle 20 rigidly connected to first cutting member 14, and a second handle 18.

Second cutting member 12 suitably comprises a blade portion 22, a central portion 24 having a first hole 28 extending therethrough, a tab 26 and a shank portion 30. First cutting member 14 suitably comprises a hook portion 32, and an extension 34 including respective second and third holes 36 and 38 extending therethrough.

First handle 20 suitably comprises a body portion 46 and a leg portion 48 including respective oppositely disposed side panels 40 and 42 joined by a support panel 44. Side panels 40 and 42 illustratively extend the entire length of handle 20; support panel 44 preferably comprises a limited portion of the perimeter of body 46. A leaf spring 98, includes a proximal end rigidly secured within handle 20, and a distal end configured to urge tab 26 in the direction indicated by arrow A (FIG. 1). As discussed in greater detail below, spring 98 cooperates with second cutting member 12 to urge respective handles 18 and 20 into the opened position.

Body 46 illustratively includes respective first and second pivot holes 50 and 52 extending through respective side panels 40 and 42. Body 46 further comprises a lengthwise slot 54, also extending through respective side panels 40 and 42.

Second handle 18 suitably comprises respective oppositely disposed side panels 56 and 58 joined by a support panel 60. A radiused portion 62, comprising respective end portions of panels 56 and 58, is disposed at one end of handle 18. Radiused portion 62 includes a third pivot hole 64 extending through respective panels 56 and 58.

Handle 18 further includes a fulcrum 66 and a limit stop 68 configured to cooperate with shank 30, as discused below. Fulcrum 66 and limit stop 68 advantageously comprise respective cylindrical shafts extending between and mounted to respective panels 56 and 58.

Shank 30 preferably includes a dogleg 70, comprising a seat 72 for engagement with limit stop 68, and a bearing surface 74 for sliding engagement with fulcrum 66. Shank 30 and tab 26 are configured to define a U-shaped channel 76 therebetween.

Figure 5:
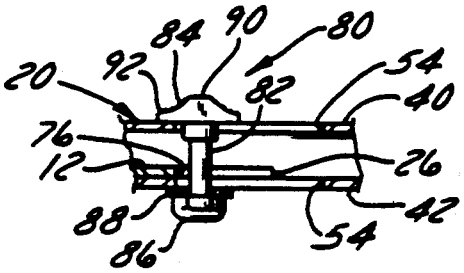
FIG. 5 is a cross section view, taken along line 5—5 in FIG. 3.
Figure 3:
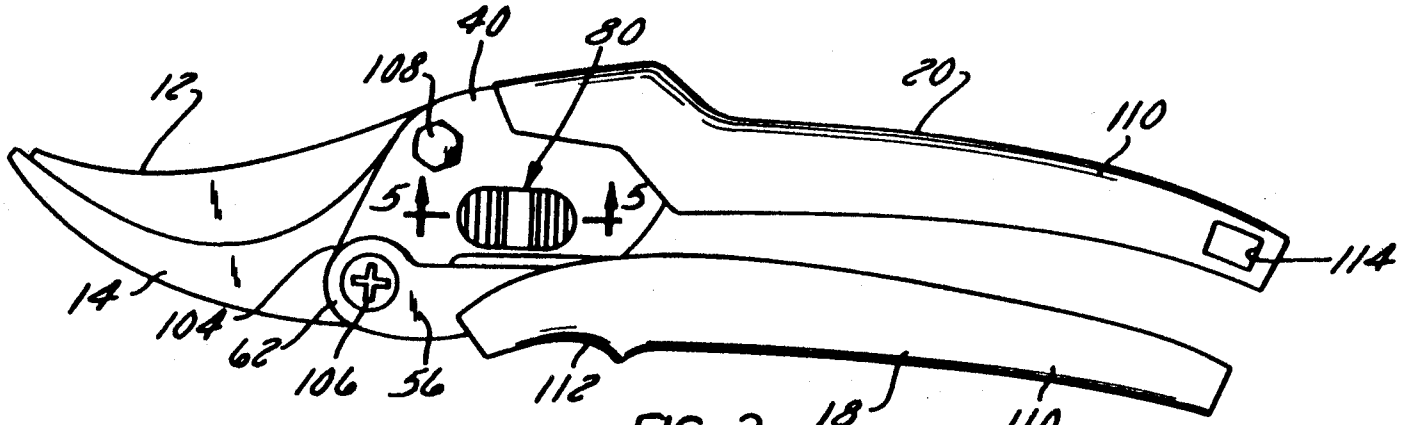
FIG. 3 is a side elevational view, similar to FIG. 2, showing the external components of the tool.
Figure 2:
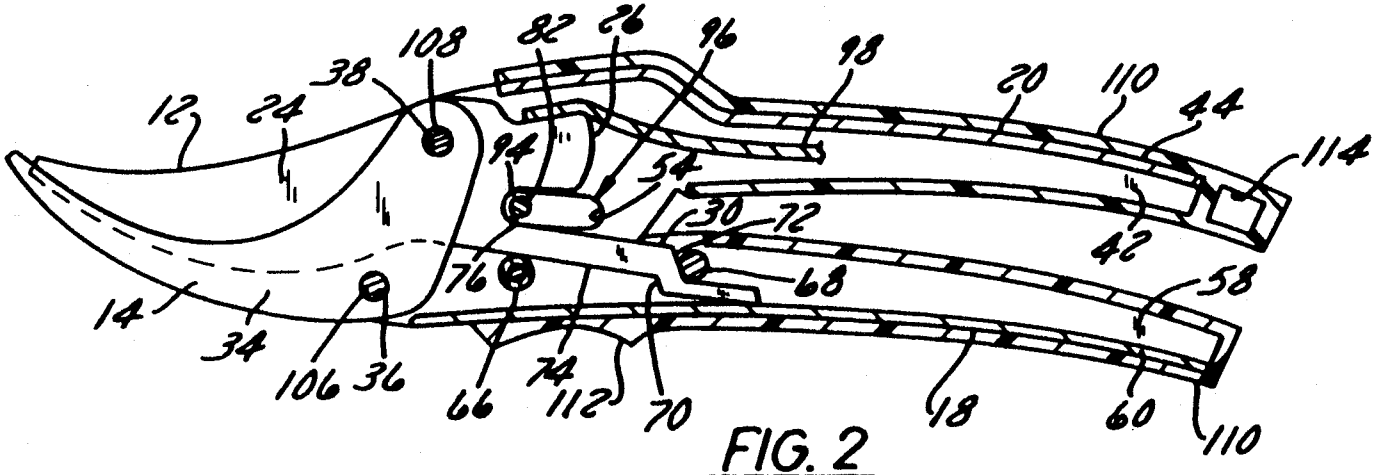
FIG. 2 is a cross section side elevational view, similar to FIG. 1, of the tool in the closed position and showing a portion of the cutting mechanism.

Referring now to FIGS. 2, 3, and 5, a locking mechanism 80 is configured for sliding disposition within slot 54 on body 20. More particularly, a shaft 82 is rigidly secured between an actuator 84 and a fastener 86, for example a screw, bolt, rivet, or the like. A spacer 88 is beneficially disposed between fastener 86 and panel 42 to prevent sliding frictional contact therebetween. For this purpose, spacer 88 may be made from plastic, polyethylene, polypropylene, various copolymers thereof, or any suitable material exhibiting high lubricity.

In a highly preferred embodiment, actuator 84 includes a raised middle portion 90 flanked by a series of steps 92 on either side thereof. Actuator 84 is suitable generally ovular or rectangular, having a lengthwise axis approximately parallel to the lengthwise axis of tool 10. In this manner, the operator's thumb may be conveniently used to manipulate actuator 84 from a fore position 94 (toward the cutting members) to an aft position 96 (toward the handles) within slot 54.

Figure 4:
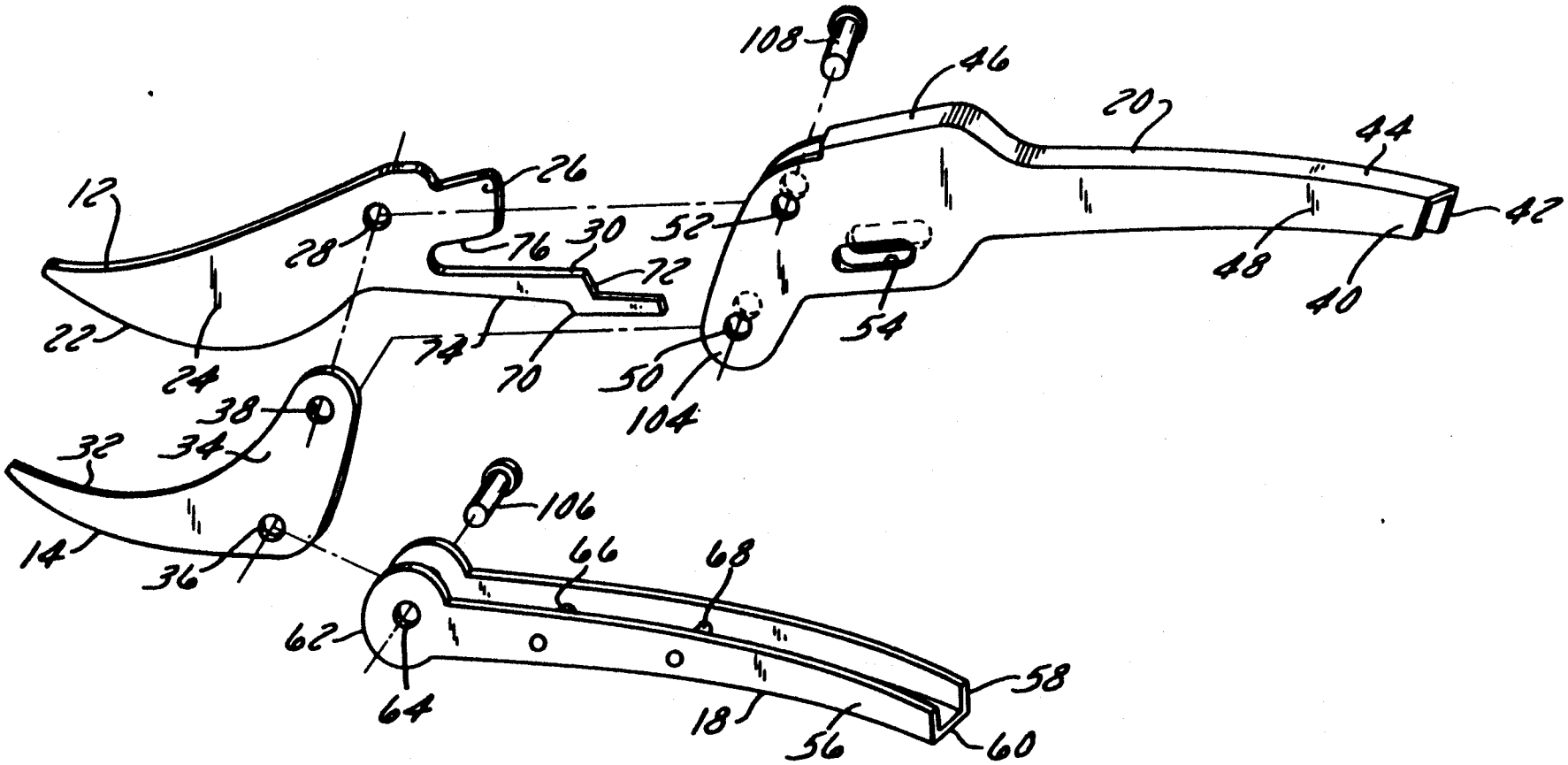
FIG. 4 is an explodede view of the tool shown in FIGS. 1-3.
Figure 7:
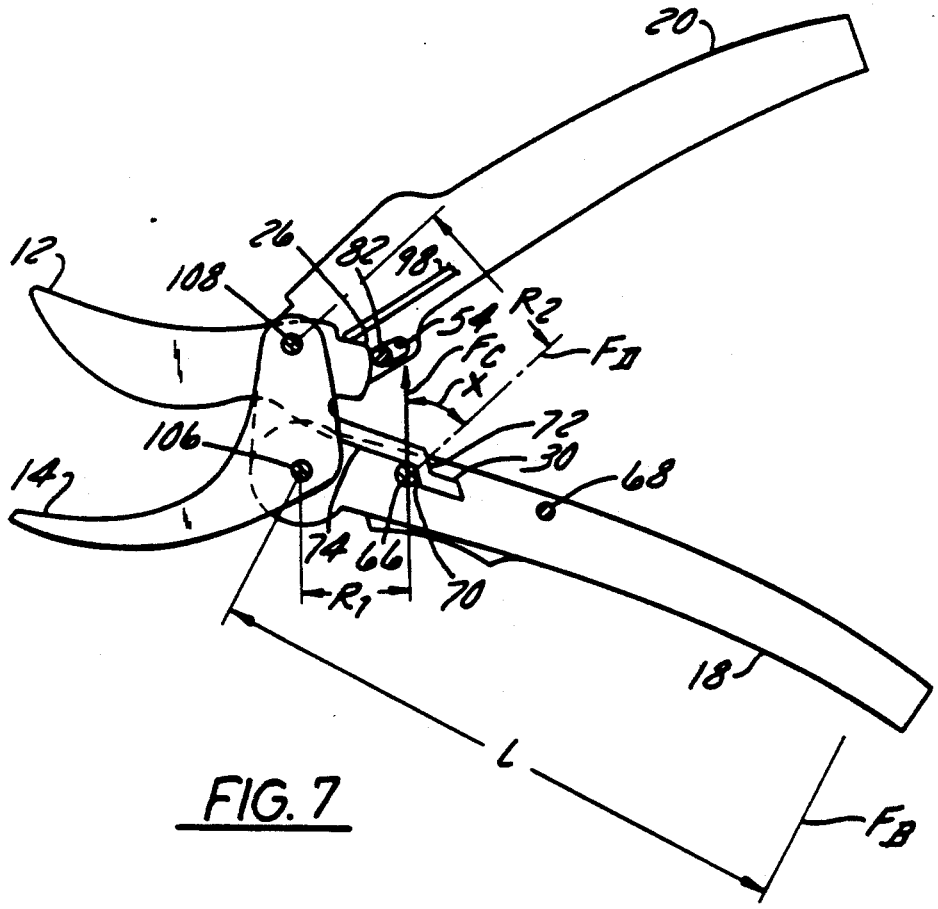
FIG. 7 is a schematic representation of the compound action leverage mechanism in accordance with the present invention.
Figure 6:
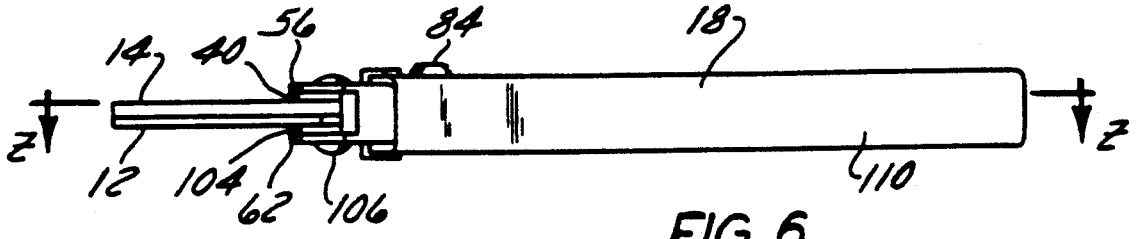
FIG. 6 is a bottom view of the tool shown in FIG. 3.

Referring now to FIGS. 2, 4 and 7, body portion 46 of first handle 20 further comprises a rounded projection 104 in the vicinity of first pivot hole 50. Projection 104 is conveniently configured for receipt within radiused portion 62, such that the portion of side panels 40 and 42 in the vicinity of projection 104 are received between respective side panels 56 and 58 of handle 18 in the vicinity of radiused portion 62. As best seen in FIG. 6, second cutting member 14 is advantageously received within body 46 between respective side panels 40 and 42 of handle 20.

First handle 20, second handle 18, and first cutting member 14 are conveniently disposed such that first pivot hole 50, third pivot hole 64, and second hole 36, respectively, are coaxially aligned. A first pivot 106, for example a nut and bolt combination, rivet, or the like, extends through the aforementioned holes such that handle 18 pivots about first pivot 106 and, hence, about projection 104 and first cutting member 14.

As best viewed in FIGS. 1 and 6, central portion 24 of second cutting member 12 partially overlays extension 34 of first cutting member 14 within the region defined by side panels 40 and 42 of body portion 46. More particularly, handle 20 and first and second cutting members 14 and 12 are configured such that second pivot hole 52, first hole 28 of second cutting member 12, and third hole 38 of first cutting member 14, respectively, are coaxially aligned. A second pivot 108 is disposed within and extends through the aforementioned holes such that second cutting member 12 pivots thereabout.

With reference now to FIGS. 1 and 4, first cutting member 14 is rigidly secured to handle 20 in two spaced apart locations: 1) first pivot 106, which extends through second hole 36 of second cutting member 14 and first pivot hole 50 of handle 20; and 2) second pivot 108, which extends through third hole 38 of first cutting member 14 and second pivot hole 52 of handle 20. In this manner, first cutting member 14 and handle 20 effectively constitute an integral, rigid member. Indeed, the description of the compound force mechanism may be greatly simplified by considering first cutting first 14 and first handle 20 to be of unitary construction.

Second cutting member 12, on the other hand is configured to rotate about second pivot 108 in response to the manual application of force to handles 18 and 20 in the following manner.

With reference to FIGS. 1 and 3, an operator typically applies a force, indicated by the vector $F_B$, to the handles during the cutting operation. Although the handles are typically squeezed with the operator's hand in a manner which distributes the total applied force between the two handles, the analysis may be simplified by viewing the system as if handle 20 were fixed. Thus, $F_B$ represents the net force applied to the handles.

Handle 18 pivots about pivot 106. As such, fulcrum 66, which is rigidly mounted to handle 18, also pivots about pivot 106. For a given torque about pivot 106, force is inversely proportional to lever length. Thus, the force generated at fulcrum 66 and indicated by the vector $F_C$ may be expressed as:

$$F_C = F_B(L/R_1)$$

where L is the effective length of handle 18, from pivot 106 to the point of application of $F_B$ and $R_1$ is the effective lever length associated with fulcrum 66, i.e., the distance between pivot 106 and fulcrum 66. Assuming a constant applied force $F_B$ and recognizing that $R_1$ remains constant throughout the cutting stroke, the maximum force delivered at fulcrum 66 ($F_C$) is also constant throughout the cutting stroke. However, not all of the force available at fulcrum 66 is actually transmitted to the cutting members.

Particularly, force is applied to second cutting member 12 at the point of interaction between fulcrum 66 and bearing surface 74 of shank 30. However, fulcrum 66 swings an arc about pivot 106, whereas bearing surface 74 swings in arc about pivot 108. Consequently, the precise point along the length of shank 30 at which force is applied changes as a function of cutting stroke. As a result, lever length $R_2$, comprising the distance between pivot 108 and the point of interaction between fulcrum 66 and bearing surface 74, also varies as a function of cutting stroke.

The amount of force supplied by fulcrum 66 which is ultimately applied to second cutting member 12 is a function of the angle between respective vectors $F_C$ and $F_D$, the perpendicular to an imaginary line between pivot 108 and the point of interaction between fulcrum 66 and bearing surface 74. Thus, the force actually applied to cutting member 12 may be expressed as:

$$F_D = F_C(\cos X)$$

where X represents the angle between vectors $F_C$ and $F_D$. The direction of vector $F_C$ changes throughout the cutting stroke as a function of the position of second handle 18. The direction of vector (arrow) $F_D$ also changes as a function of cutting position, although at a lower rate of change than vector $F_C$. Thus, angle X is an increasing function of cutting stroke. Inasmuch as the cosine function is a decreasing function of angle X, it can be seen that maximum cutting force is delivered to second cutting member 12 when the handles are in the open position.

Returning now to FIGS. 1–3 and 7, spring 98 is fixed within handle 20 at a spring mount 102 such that the free end of spring 98 exerts a downward force, generally in the direction of arrow A, on tab 26. Second cutting member 12, including shank 30, is thus urged in a clockwise direction about pivot 108. Bearing surface 74 of shank 30, in turn, urges fulcrum 66, and hence handle 18, away from handle 20. In this way, cutting tool 10 is biased in the open-handle position.

At substantially all points in the cutting stroke except the closed position, as seen in FIGS. 1 and 7, shaft 82 of locking mechanism 80 is disposed proximate tab 26. As such, shaft 82 is constrained to the aft position 96 within slot 54. More specifically, second cutting member 12, including tab 26, is received within body 46, as described above. Slot 54 is configured proximate tab 26 such that shaft 82 abuts tab 26 and prevents locking actuator 84 from being moved forward while the handles are open.

When the handles 20 and 18 are in the closed position as shown in FIGS. 2 and 3, on the other hand, slot 54 assumes a generally overlying position with respect to channel 76. In this position, the operator may conveniently slide actuator 84 into the fore position 94 of slot 54, thereby wedging shaft 82 between tab 26 and shank 30; that is, shaft 82 may be urged into channel 76 only when the handles are in the closed position.

In the locked position, the free end of spring 98 continues to exert a downward force on tab 26, but shaft 82, which is constrained within slot 54 of handle 20, prevents tab 26 from moving downwardly. As a result, rotation of second cutting member 12 is prevented.

When it is desired to unlock tool 10, the operator draws actuator 84 rearwardly (to the right in FIGS. 2 and 3) so that shaft 82 again occupies the aft portion 96 of slot 54, thereby permitting spring 98 to separate the handles of the cutting tool.

With continued reference to FIGS. 1, 2, 4 and 7, limit stop 68 is configured to contact seat 72 of shank 30 when cutting tool 10 assumes a closed position. When seat 72 contacts stop 68, further closure of the tool is prevented. In this manner, injury to the operator's hand and, additionally, damage to the blades may be substantially prevented.

In accordance with a further aspect of the present invention, selected portions of handles 18 and 20 are advantageously covered with a resilient, durable coating 110 made from, for example, plastic, polyethylene, polypropylene, and various copolymers thereof.

As best seen in FIG. 1, cover 110 may include an indentation 112 to accommodate the operator's index finger. In addition, a loop 114 may be formed at the distal end of the one of the handles to accommodate a string so that the tool may be tied, for example, to the operator's wrist, belt, or tool caddy.

It will be understood that the above description is of preferred exemplary embodiments of the present invention, and that the invention is not limited to the specific forms shown. For example, a blade and anvil combination may be substituted for the hook and blade cutting members described herein. Further, the handles need not comprise a U-shaped cross section; a solid, rectangular, or ovular cross section may be employed. These and other modifications may be made in the design and arrangement of the elements within the scope of the invention as expressed in the appended claims.

I claim:

1. A cutting tool having respective first and second cutting members cooperating to effect a cutting stroke between an open position and a closed position, said cutting tool comprising:

a first handle rigidly connected to said first cutting member;

a pivot connection configured to effect pivotal motion between said first and second cutting members;

a spring rigidly mounted to said first handle;

a second handle cooperating with said second cutting member to effect said cutting stroke;

a shank rigidly attached to said second cutting member;

a tab rigidly attached to said second cutting member, said tab and said shank being configured to define a channel therebetween, wherein said spring is configured to cooperate with said tab to urge said handles toward said open position; and a locking member slideably mounted in a longitudinally extending slot formed in said first handle, said locking member being slideable within said slot from a locked position in which it is received within said channel to an unlocked position in which it is located outside of said channel.

2. The tool of claim 1 wherein:

said first handle comprises respective first and second panels joined by a support panel to define a U-shaped region; and wherein said spring comprises a leaf spring having respective first and second ends, said first end being mounted within said U-shaped region and said second end contacting said tab.

3. A compound action cutting tool including respective first and second tool members configured to effect a cutting stroke between an open and a closed position, wherein:

said first tool member comprises a first cutting member and a first handle rigidly secured to said first cutting member, the tool further comprising:

a second cutting member pivotably secured to said first cutting member and having an elongated shank portion extending rearwardly therefrom;

a second tool member including said second cutting member and a second handle pivotably secured to said first tool member and further including a fulcrum rigidly secured to said second handle, said fulcrum being configured for sliding interaction with said elongated shank portion to effect said cutting stroke in response to said pivoting of said second handle; and a limit stop rigidly secured to said second handle and configured to abut said elongated shank portion when said tool is in the closed position, to thereby prevent further closure of said tool.

4. A cutting tool comprising:

a first tool member comprising a first cutting member and a first handle fixedly connected to said first cutting member;

a second tool member comprising a second handle having first and second longitudinal ends and a second cutting member located proximate said first longitudinal end of said second handle and pivotally attached to said first cutting member via a pivot member, said second cutting member having a shank portion extending toward said second longitudinal end of said second handle;

a fulcrum which is rigidly attached to said second handle and which provides sliding interaction between said second handle and said elongated shank portion to effect a cutting stroke in response to a pivoting action of said second handle towards said first handle; and a limit stop rigidly secured to said second handle and configured to abut said elongated shank portion when said tool is in the closed position, to thereby prevent further closure of said tool.

5. The cutting tool of claim 4, wherein said fulcrum slides towards said pivot member during a pivoting action of said second handle to effect a cutting force that decreases as said pivoting action progresses.

* * * * *